US005765984A

United States Patent [19]

Stefano et al.

[11] Patent Number: 5,765,984

[45] Date of Patent: Jun. 16, 1998

[54] METHOD AND DEVICE FOR THE AUTOMATIC LOADING AND DISCHARGE OF PIECES OF SHEET METAL

[75] Inventors: Vergano Stefano; Scavino Mario; Azzinnaro Franco; Francesco Leone, all of Turin, Italy

[73] Assignees: Amada Metrecs Company, Limited, Kanagawa, Japan; Crea S.R.L., Turin, Italy

[21] Appl. No.: 763,884

[22] Filed: Dec. 11, 1996

[30] Foreign Application Priority Data

Dec. 12, 1995 [IT] Italy ..... TO95A0999

[51] Int. Cl.[6] ..... B65G 1/04

[52] U.S. Cl. ..... 414/222; 414/793; 414/797

[58] Field of Search ..... 414/792.8, 792.9, 414/793, 793.2, 797, 797.1, 222

[56] References Cited

U.S. PATENT DOCUMENTS

| | | | |
|---|---|---|---|
| 4,465,426 | 8/1984 | Jonsson | 414/222 |
| 4,565,478 | 1/1986 | Ericsson | 414/793 |
| 4,648,786 | 3/1987 | Sakurai | 414/222 |
| 5,358,375 | 10/1994 | Kawada et al. | 414/222 |

FOREIGN PATENT DOCUMENTS

| | | | |
|---|---|---|---|
| 2103954 | 8/1972 | Germany | 414/793.2 |

*Primary Examiner*—Karen M. Young
*Assistant Examiner*—Gregory A. Morse
*Attorney, Agent, or Firm*—Wigman, Cohen, Leitner & Myers, P.C.

[57] ABSTRACT

In order to load and discharge pieces of sheet metal automatically onto and from a machine tool having a horizontal table movable along a first horizontal axis, a horizontal discharge table and a horizontal loading table are provided in positions in which the tables are side by side and substantially aligned with the horizontal plane of the table of the machine tool. An unprocessed piece of sheet metal to be supplied to the machine tool is placed on the loading table. Initially, the piece-holding table of the machine tool is positioned beside the discharge table. The piece of sheet metal on the piece-holding table is transferred to the discharge table by being slid on the bearing surfaces of the tables in the direction of a second horizontal axis perpendicular to the first axis. The table of the machine tool is then moved to a position in which it is beside the loading table. The unprocessed piece of sheet metal situated on the loading table is then transferred to the piece-holding table by being slid on the bearing surfaces of these tables.

8 Claims, 11 Drawing Sheets

METHOD AND DEVICE FOR THE AUTOMATIC LOADING AND DISCHARGE OF PIECES OF SHEET METAL

BACKGROUND OF THE INVENTION

The present invention relates to the processing of pieces of sheet metal and concerns a method and a device for the automatic loading and discharge of pieces of sheet metal onto and from a machine tool having a horizontal table which is movable along a first horizontal axis and can support a piece of sheet metal being processed.

The method and the device according to the present invention have been developed in particular for the loading and discharge of pieces onto and from a punching machine but may be used with any machine tool having a horizontally-movable, piece-holding table.

SUMMERY OF THE INVENTION

In designing a new loading and discharge system for a punching machine, the Applicant's aim was to reduce the weight of the structures for handling pieces of sheet metal, to optimize the speed of the loading and discharge operation, and to reduce the size of the storage areas for the unprocessed pieces and for the processed pieces.

In order to achieve the above object, there is provided a method for the automatic loading and discharge of pieces of sheet metal onto and from a machine tool having a horizontal table which is movable along a first horizontal axis and can support a piece of sheet metal being processed, characterized in that it comprises the steps of:

providing a horizontal discharge table and a horizontal loading table in positions in which these tables are side by side and substantially aligned with the horizontal plane of the table of the machine tool, providing an unprocessed piece of sheet metal to be supplied to the machine tool on the loading table, positioning the table of the machine tool in a discharge position in which it is substantially beside the discharge table, transferring the processed piece of sheet metal from the table of the machine tool to the discharge table causing it to slide on the bearing surfaces of these tables along a second horizontal axis perpendicular to the first axis, moving the table of the machine tool along the first axis to a loading position in which it is substantially beside the loading table, and transferring the unprocessed piece of sheet metal from the loading table to the table of the machine tool by causing it to slide on the bearing surfaces of the tables, along the second horizontal axis.

In a preferred embodiment, the unprocessed pieces of sheet metal are disposed on the loading table by a preparation sequence comprising the steps of:

positioning the discharge table above a stack of unprocessed pieces of sheet metal, taking a piece of sheet metal from the top of the stack with the use of gripping means situated on the lower surface of the discharge table, and positioning the discharge table above the loading table and depositting the piece of sheet metal on the upper surface of the loading table.

In another preferred embodiment, the processed pieces of sheet metal are discharged from the discharge table in a discharge sequence comprising the steps of:

bringing the discharge table above an area for the deposition of processed pieces, restraining the processed piece of sheet metal situated on the discharge table by means of a stationary catch element which prevents the piece of sheet metal from moving along the direction of movement of the discharge table, and moving the discharge table in the direction of movement so as to discharge the piece of sheet metal into the deposition area.

In still another preferred embodiment, the loading table and the discharge table are carried by a lifting platform which is movable vertically and can take up a raised position in which the plane of the discharge table is above the area for the deposition of the processed pieces and a lowered position in which the plane of the discharge table is above a stack of unprocessed pieces of sheet metal.

In order to achieve the above object, there is provided a device for the automatic loading and discharge of pieces of sheet metal onto and from a machine tool having a horizontal table which is movable along a first horizontal axis and can support a piece of sheet metal being processed, characterized in that it comprises:

a stationary base, a lifting platform movable vertically relative to the base, a horizontal discharge table movable relative to the lifting platform parallel to the first axis, a horizontal loading table movable in a vertical direction relative to the lifting platform between a position in which it is below the plane of the discharge table and a position in which it is substantially aligned with the discharge table, a stationary guide beam extending along a second horizontal axis perpendicular to the first axis, and an entrainment carriage which has means for gripping pieces of sheet metal and is movable along the guide beam between a position for picking up pieces on the loading table or releasing pieces onto the discharge table and a position for picking up pieces from and releasing pieces onto the table of the machine tool.

In a preferred embodiment, the base has a storage region in which an area for the deposition of the processed pieces of sheet metal and a stack of unprocessed pieces of sheet metal are disposed one above the other.

In another preferred embodiment, it comprises a restraining device which can prevent the movement of a processed piece of sheet metal bearing on the discharge table in the direction of movement of the discharge table so that the movement of the discharge table parallel to the first axis causes the processed piece of sheet metal to be discharged into the deposition area.

In still another preferred embodiment, the discharge table has gripping means on its lower surface for gripping an unprocessed piece of sheet metal.

DETAILED DESCRIPTION OF THE PREFERRED EMBODIMENTS

Further characteristics and advantages of the present invention will become clear in the course of the following detailed description given purely by way of non-limiting example, with reference to the appended drawings.

Figure 1:
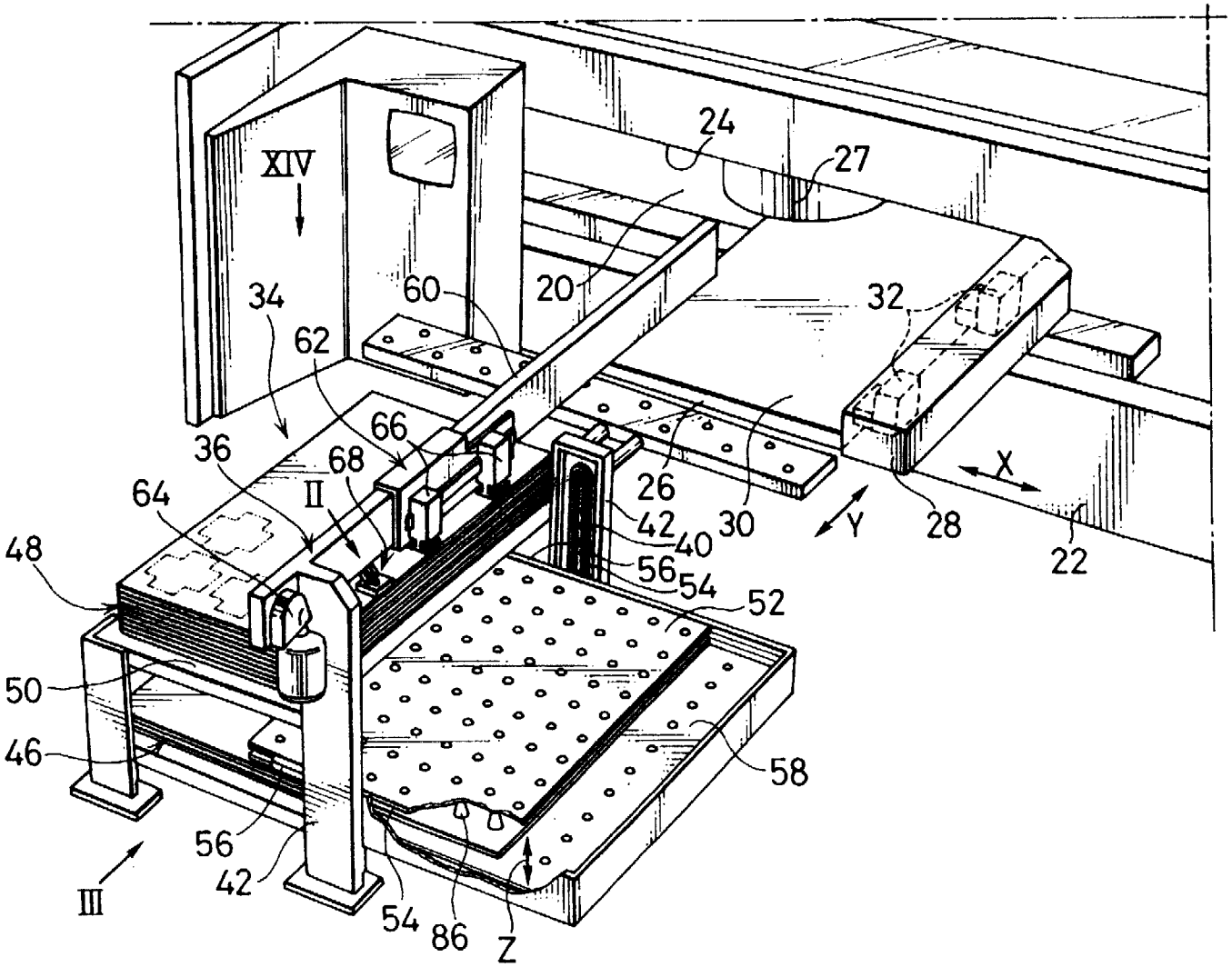
FIG. 1 is a schematic perspective view of a device according to the present invention, associated with a punching machine.

With reference to FIG. 1, a machine tool, in the specific embodiment a punching machine, for processing pieces of sheet metal, is indicated 20. The machine 20 comprises a base 22 with a central opening 24 through which a horizontal piece-holding table 26 extends. The machine 20 has a tool-holder turret 27 and a beam 28 for the movement of a piece of sheet metal 30 being processed. The upper surface of the piece-holding table 26 has a plurality of balls on which the piece of sheet metal 30 can slide with low friction.

The piece-holding table 26 is movable along the axis X, together with the beam 28, in order to perform movements for positioning the piece of sheet metal 30 along the axis X relative to the tool-holder turret 27. The piece of sheet metal 30 resting on the table 26 is held by the beam 28, by means of grippers 32. For movements to position the piece 30 along the axis Y the piece-holding table 26 remains stationary and the grippers 32 are moved along the axis Y, along the beam 28.

In front of the machine 20 there is an automatic loading and discharge device, indicated 34. The device 34 comprises a stationary base 36 which carries a lifting platform 38 movable vertically along guides 40 carried by a pair of uprights 42. In a position beside the lifting platform 38 the base 36 has a storage area 44 in which there is a stack 46 of unprocessed pieces of sheet metal and a stack 48 of processed pieces of sheet metal situated in a deposition area 50 disposed above the area holding the stack 46 of unprocessed pieces of sheet metal.

The lifting platform 38 carries a discharge table 52 having, on its upper surface, a plurality of balls on which a piece of sheet metal is free to slide with low friction. The discharge table 52 is carried by the lifting platform 38 in a manner such that it can slide parallel to the axis X. The sides 54 of the discharge table 52 engage a pair of telescopic guides 56 which allow the discharge table 52 to adopt two operative positions in which it is slid out fully or retracted fully relative to the lifting platform 38. The movement of the discharge table 52 parallel to the axis X is brought about by conventional electric actuators which have not been shown for easier understanding of the drawings.

The lifting platform 38 also carries a loading table 58 which also has a plurality of balls on its upper surface. The loading table 58 can move solely along a vertical axis Z relative to the lifting platform 38. The movement of the loading table 58 along the axis Z is brought about by an actuator, not shown. By moving along the axis Z, the loading table 58 can adopt a lowered position in which it extends below the plane of the discharge table 52 and a raised position in which the loading table 58 is substantially aligned with the discharge table 52.

The discharge table 52 has means on its lower surface for gripping an unprocessed piece of sheet metal. These means are constituted, for example, by a plurality of suction cups 86 connected to a vacuum source. As will become clear from the following description, the discharge table 52 can pick up the piece of sheet metal 30 which is on top of the stack 46 of unprocessed pieces, with the use of the gripping means, and deposit the piece of sheet metal 30 on the upper surface of the loading table 58.

The stationary base 36 of the loading and discharge device 34 also carries a guide beam 60 which extends in the direction of the axis Y. A portion of the beam 60 projects above the working plane of the machine tool 20. The beam 60 is positioned above the area 50 in which the processed pieces of sheet metal 48 are depositted and is in the vertical plane which separates the storage region 44 from the lifting platform 38.

The guide beam 60 carries a carriage 62 slidable in direction of the axis Y along the beam 60 and driven by a motor 64 by means of a conventional belt transmission (not shown). The carriage 62 can also perform movements of small amplitude in the direction of the axis X relative to the beam 60, the function of which will become clear from the following description. The carriage 62 carries a pair of grippers 66 which can be activated by means of pneumatic actuators and can grip the edge of a piece of sheet metal 30 to be moved.

As will be explained further below, an important characteristic of the present invention is that the pieces of sheet metal are handled without ever being lifted from the piece-holding tables. The movement takes place by the entrainment of the piece of sheet metal on the ball surfaces of the piece-holding tables by means of the carriage 62. This allows the beam 60, the carriage 62 and, in general, all of the structures intended for transferring the pieces of sheet metal 30 to have fairly small dimensions. In particular, the fact that the pieces of sheet metal do not have to be lifted enables the beam 60 which projects over the working plane of the machine tool 20 to have dimensions such that it is very light.

Figure 2:
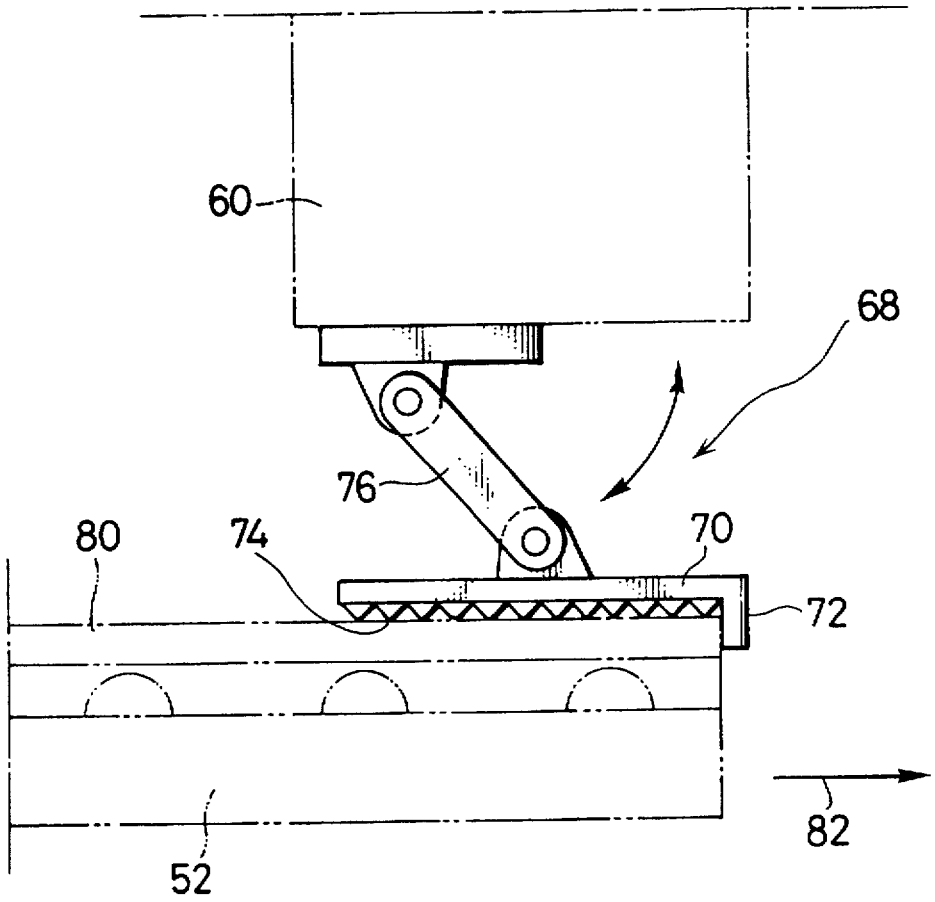
FIG. 2 is a detail of the part indicated by the arrow II in FIG. 1, on an enlarged scale.

In FIGS. 1 and 2, a restraining device which is used for discharging the pieces of sheet metal 30 situated on the upper surface of the discharge table 52 is indicated 68. As can be seen in FIG. 2, the restraining device 68 comprises a pad 70 with a catch element 72 and a rubberized lower surface 74. The pad 70 is connected to the guide beam 60 by means of an arm 76 connected to a pneumatic actuator (not shown) which controls the movement of the pad 70 between a raised, inoperative position and a lowered, operative position shown in FIG. 2.

In its operative position, the rubberized surface 74 of the pad 70 bears on the upper surface of a processed piece of sheet metal 80 which is supported on the upper surface of the discharge table 52. The catch element 72 is disposed in front of the edge of the piece of sheet metal 80 so as to prevent the piece of sheet metal 80 from moving in the direction indicated by the arrow 82 in FIG. 2.

The operating sequence of the loading and discharge device 34 according to the present invention will now be described with reference to FIGS. 3–23.

FIGS. 3–13 and 20–23 are schematic front views of the device taken on the arrow III of FIG. 1, whereas FIGS. 14–19 are plan views of the device taken on the arrow XIV of FIG. 1.

Figure 3:
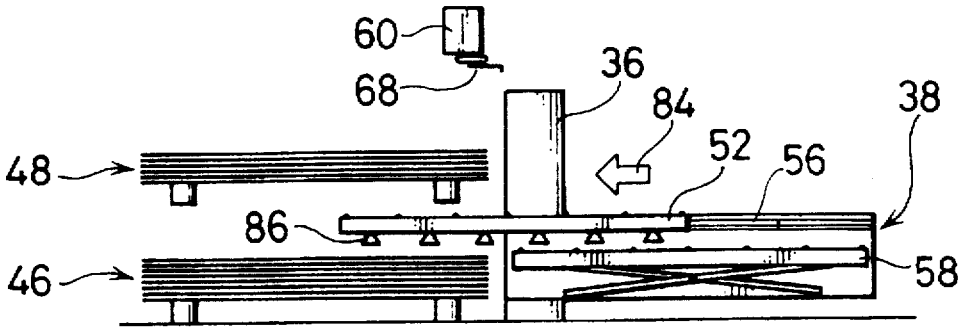
FIGS. 3–23 are schematic views showing the operating sequence of the device according to the invention.
Figure 4:
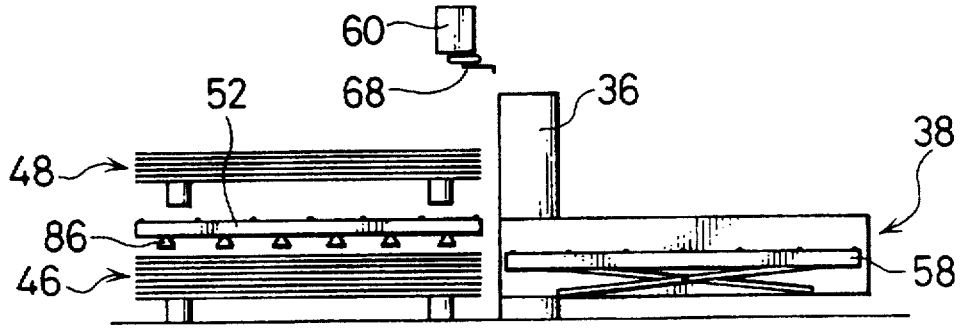
Figure 5:
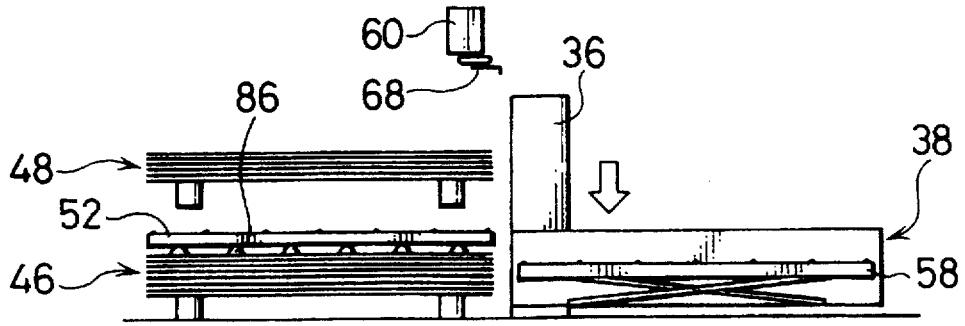
Figure 6:
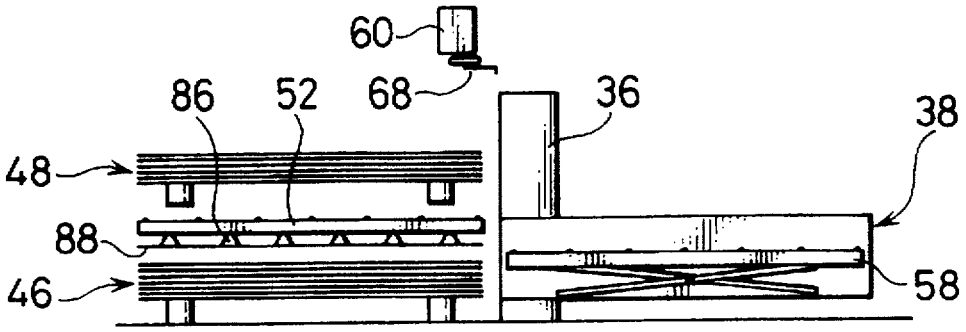
Figure 7:
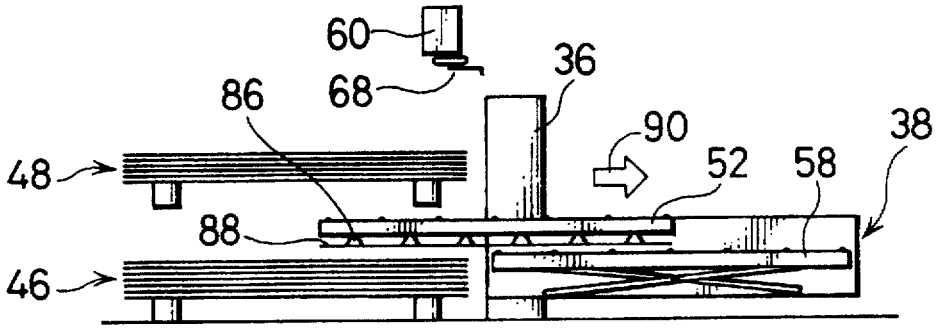

In the configuration of FIG. 3, the lifting platform 38 is at a height such that the discharge table 52 is disposed in the empty space between the stack 46 of unprocessed pieces of sheet metal and the stack 48 of processed pieces of sheet metal. The discharge table 52 is moved in the direction indicated by the arrow 84 until it reaches a position in which it is fully slid out, shown in FIG. 4. The lifting platform 38 is then lowered as shown in FIG. 5 until the suction cups 86 situated on the lower surface of the discharge table 52 come into contact with the piece of sheet metal situated on the top of the stack 46. The discharge table 52 has a position sensor (not shown) which indicates to the control unit of the loading and discharge device 34 the moment at which the suction cups 86 come into contact with the piece of sheet metal. After it has received this signal, the control unit of the device 34 interrupts the downward travel of the lifting platform 38. The suction cups 86 are then activated and the lifting platform 38 is raised slightly so as to separate an unprocessed piece of sheet metal 88 from the stack 46 (FIG. 6). The discharge table 52 is then moved in the direction indicated by the arrow 90 in FIG. 7, to bring it to a position above the loading table 58.

Figure 8:
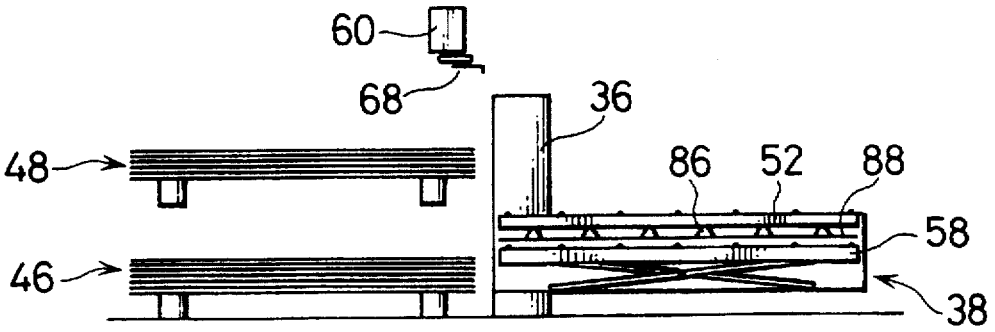
Figure 9:
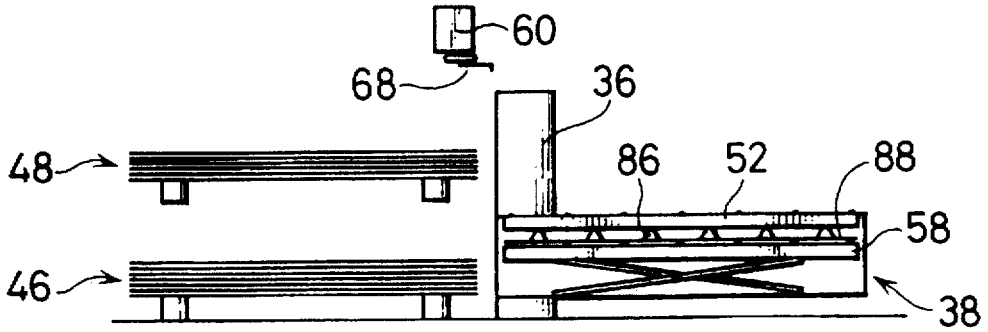

FIG. 8 shows the configuration of the device upon completion of the horizontal movement of the discharge table 52. Starting from the configuration of FIG. 8, the loading table 58 is raised until it is brought into contact with the lower surface of the piece of sheet metal 88 as shown in FIG. 9. The upper surface of the loading table 58 has at least one suction cup, or similar restraining element (not shown in the drawings), which, at this stage, adheres to the lower face of the piece of sheet metal 88 to prevent accidental movements of the piece of sheet metal 88 during the subsequent steps.

Figure 10:
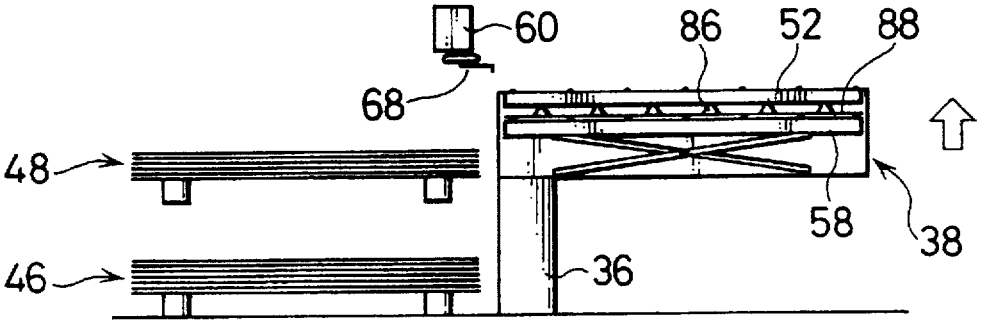
Figure 11:
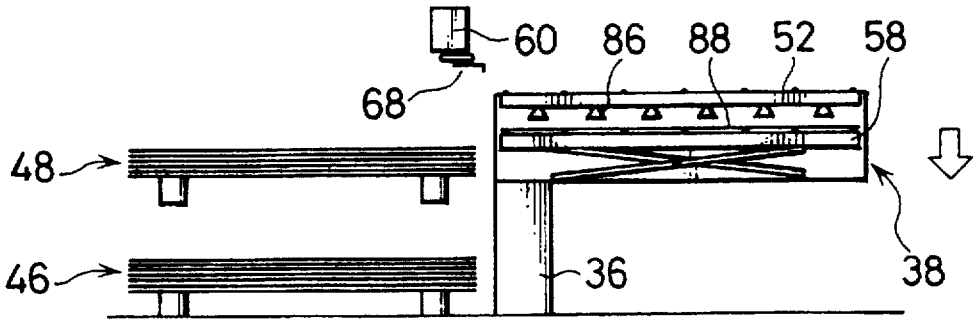
Figure 12:
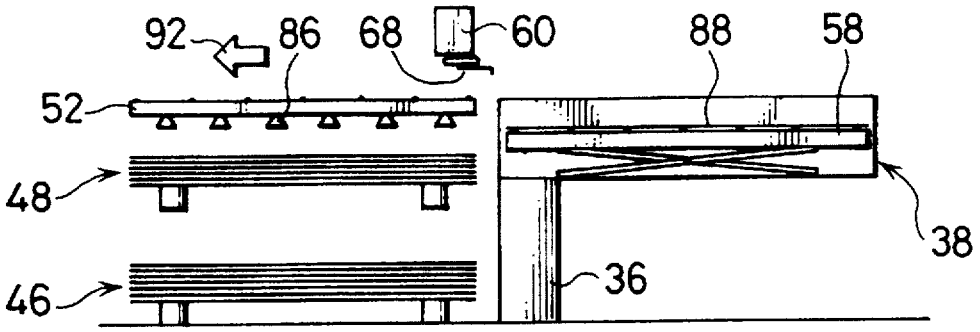

In the next step, shown in FIG. 10, the lifting platform 38 is raised to its maximum height. The suction cups 86 on the lower surface of the discharge table 52 are then de-activated as shown in FIG. 11, and the loading table 58 carrying the piece of sheet metal 88 is lowered (FIG. 11). The discharge table 52 is then brought back to its slid out position as shown in FIG. 12, by a movement in the direction indicated by the arrow 92. Finally, the loading table 58 is raised to bring it to the level of the discharge table 52 (FIG. 13).

Figure 13:
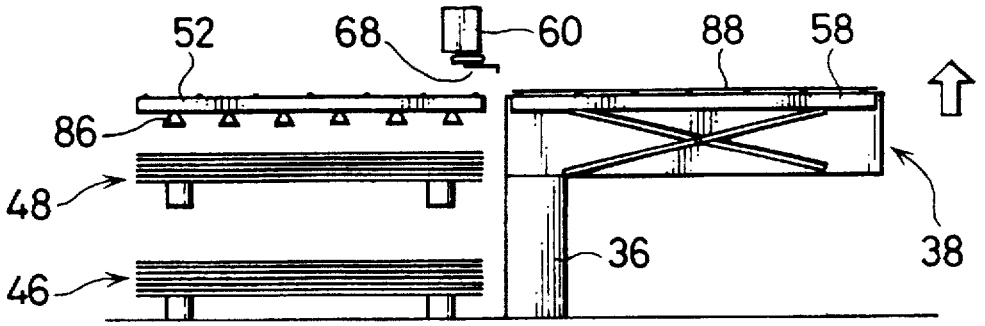

In the configuration shown in FIG. 13, the loading table 58 and the discharge table 52 are substantially coplanar with the piece-holding table 26 of the machine tool 20.

All of the steps described up to now together constitute a preparation stage which is carried out during the time cycle of the machine tool 20, that is, whilst the machine tool 20 is carrying out the programmed operations on a piece of sheet metal previously loaded onto its piece holding table 26. The time necessary to perform this preparation stage does not therefore penalize the productivity of the machine tool 20.

Figure 14:
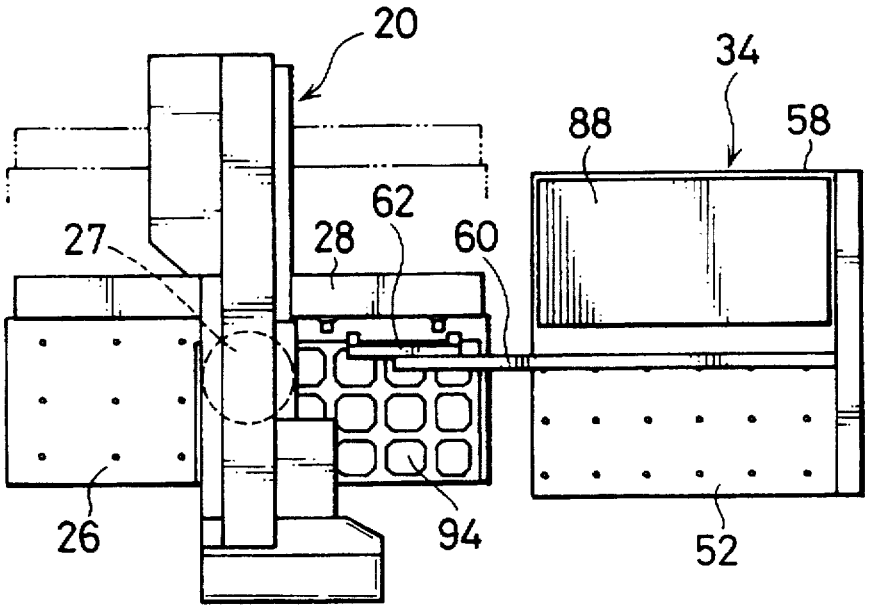
Figure 15:
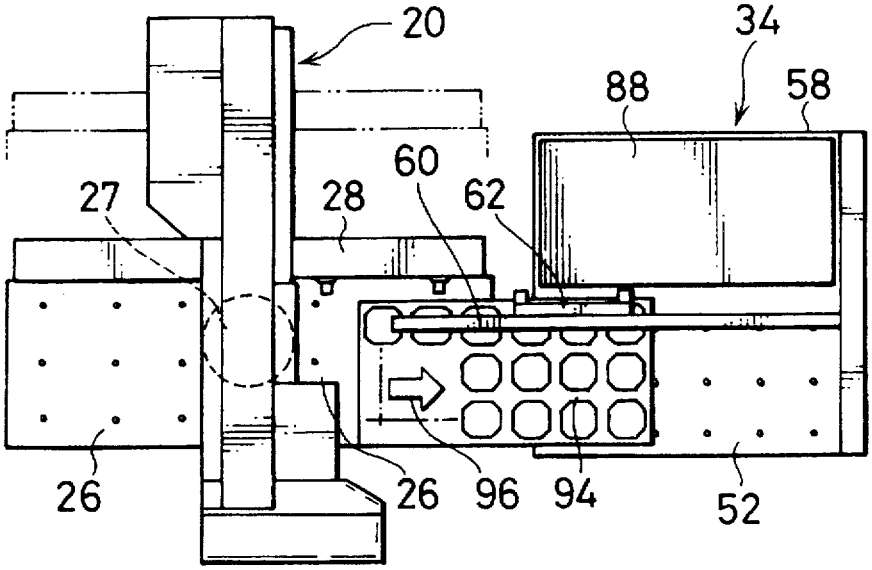

The procedure for the actual discharge and loading of the pieces of sheet metal starts as soon as the machine tool has finished the programmed processing on the previous piece. As shown in FIG. 14, upon completion of the processing, the piece-holding table 26 carrying a processed piece 94 is brought in front of the discharge table 52. The entrainment carriage 62 is brought to the end of the beam 60 as shown in FIG. 14. The grippers 66 of the carriage 62 grip the processed piece of sheet metal 94 along one edge thereof and entrain it in the direction indicated by the arrow 96 in FIG. 15 onto the discharge table 52, causing it to slide on the ball surfaces of the tables 26 and 52.

Figure 16:
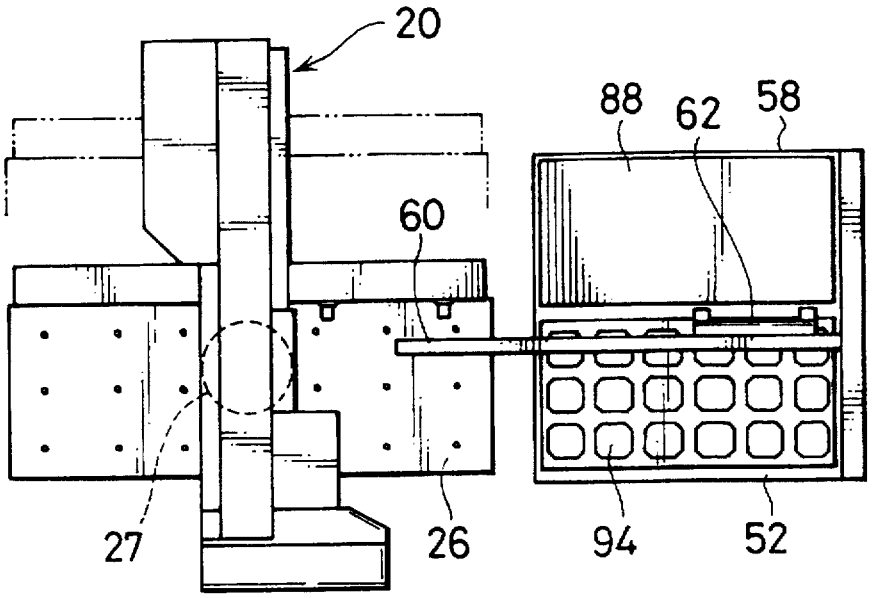
Figure 17:
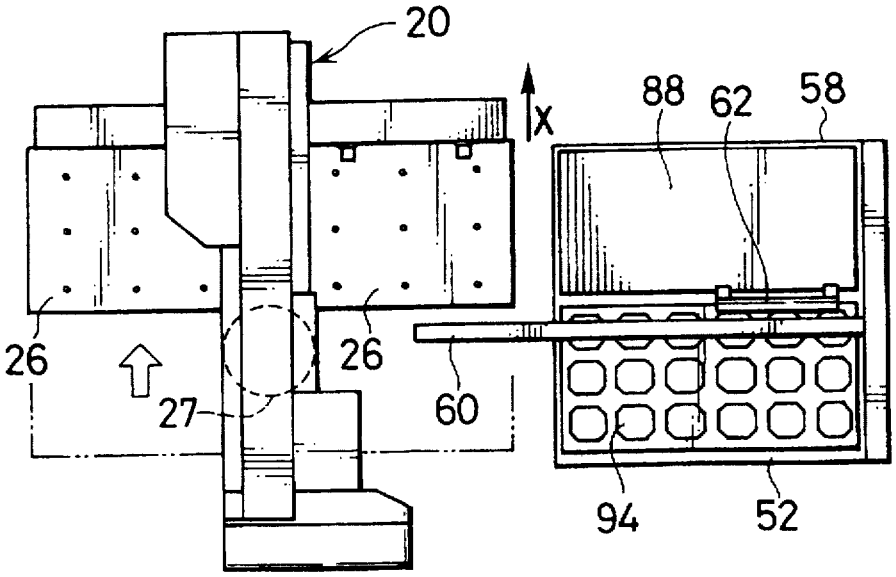
Figure 18:
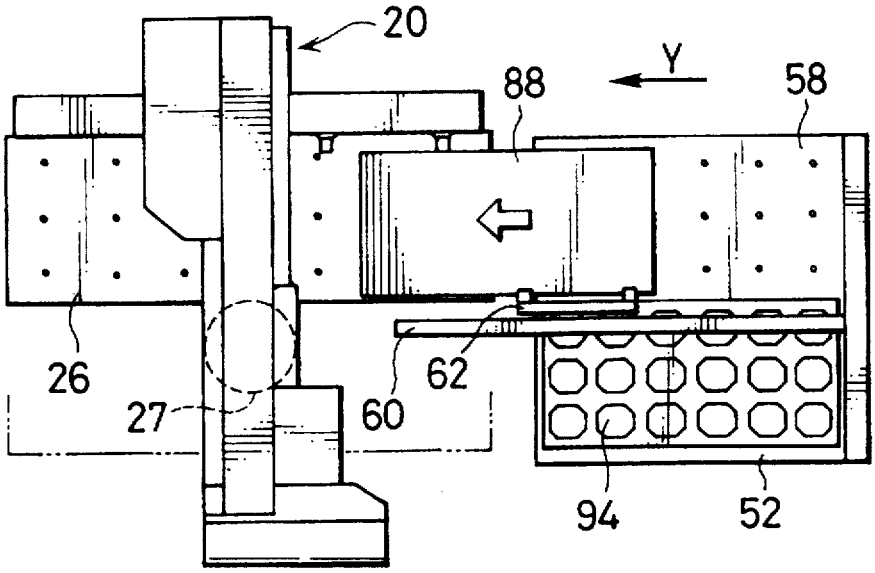

FIG. 16 shows the configuration of the system upon completion of the discharge of the processed piece of sheet metal 94. After the processed piece of sheet metal 94 has been discharged, the entrainment carriage 62 performs a small movement in the direction of the axis X and grips the unprocessed piece of sheet metal 88 situated on the discharge table 52 (FIG. 17). Before the grippers of the carriage 62 release the processed piece of sheet metal 94, the restraining device 68 is activated so as to bring the restraining pad 70 into engagement with the piece of sheet metal 94 and restrain it on the discharge table 52 so as to prevent accidental movements thereof. At the same time, the piece-holding table 26 of the machine tool 20 moves along the axis X and is brought in front of the discharge table 52 again as shown in FIG. 17. The entrainment carriage 62 is then moved along the axis Y, entraining the unprocessed metal sheet 88 onto the piece-holding table 26 of the machine tool 20 (FIG. 18).

Figure 19:
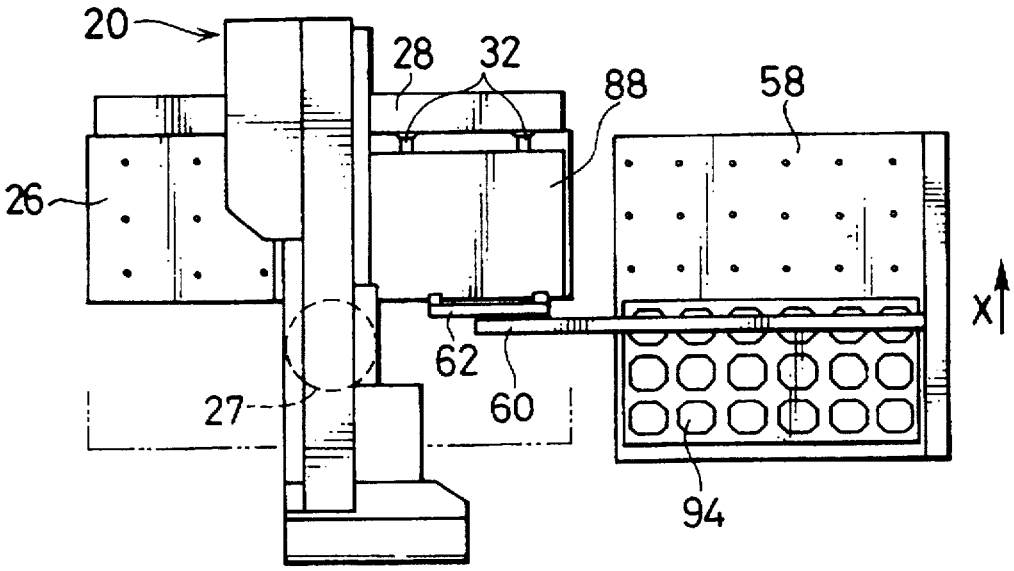

FIG. 19 shows the configuration of the system upon completion of the loading of the unprocessed metal sheet 88. The unprocessed piece of sheet metal 88 is brought into engagement with the grippers 32 of the movement beam 28 of the machine tool 20 by a small travel of the entrainment carriage 62 in the direction of the axis X.

Upon completion of the loading stage, the machine tool 20 starts the programmed processing on the unprocessed piece of sheet metal 88. Whilst the machine tool 20 is carrying out the processing programme on the new piece of sheet metal 88, the loading and discharge device 34 carries out the stage of the deposition of the processed piece of sheet metal on the stack 48 of processed pieces of sheet metal.

Figure 20:
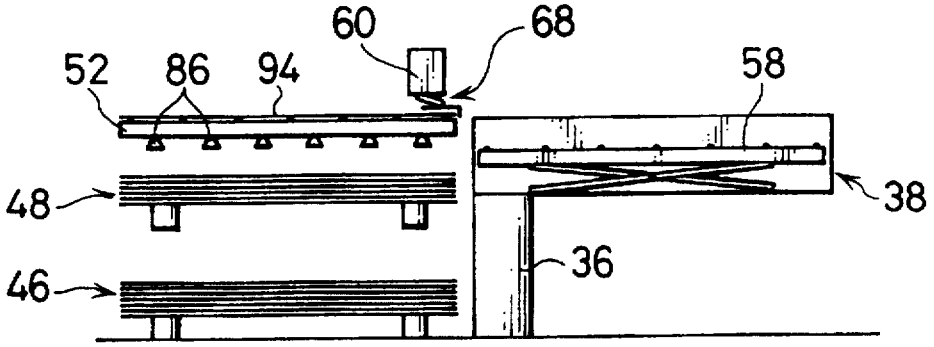
Figure 21:
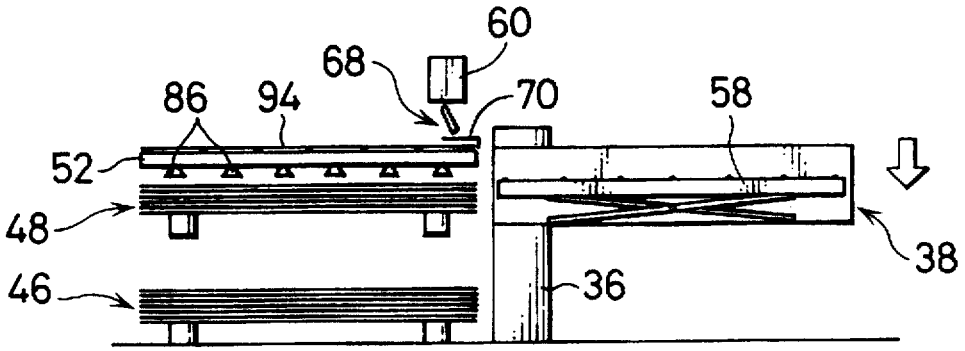

With reference to FIG. 20, the loading table 58, which initially is aligned with the discharge table 52, is lowered. The entire lifting platform 38 is then lowered, as shown in FIG. 21, so as to bring the discharge table 52 as close as possible to the top of the stack 48 of processed pieces of sheet metal but without the suction cups 86 coming into contact with the piece of sheet metal situated on the top of the stack (FIG. 21).

Figure 22:
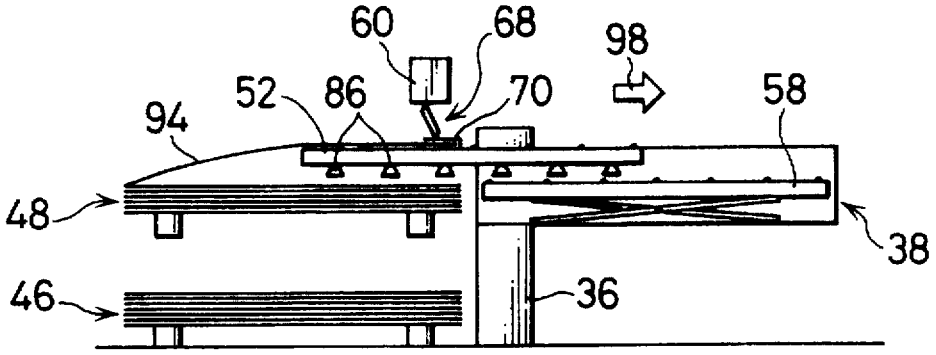

In the next step shown in FIG. 22, the discharge table 52 is moved in the direction indicated by the arrow 98.

Since the processed piece of sheet metal 94 is engaged by the pad 70, it cannot move in the direction 98 and is therefore discharged from the table 52 and placed on the stack 48.

Figure 23:
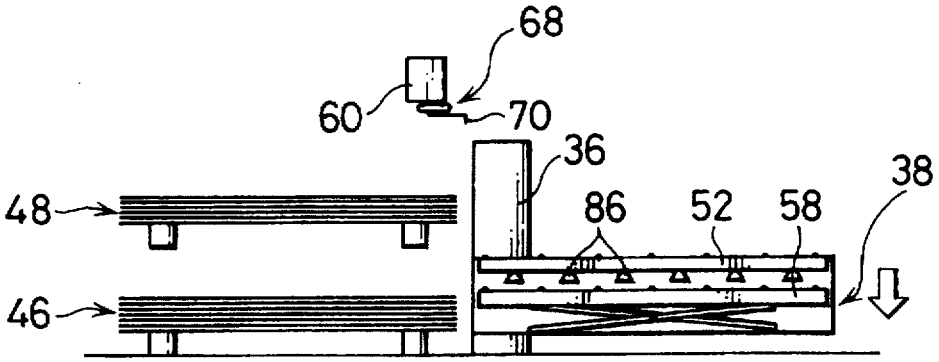

Finally, the lifting platform 38 is lowered as shown in FIG. 23 and the device is ready to start a new operating cycle. When the stack 48 of processed pieces of sheet metal reaches a predetermined size, it is taken from the storage area by means of a normal forklift.

What is claimed is:

1. A method for the automatic loading and discharge of pieces of sheet metal onto and from a machine tool having a horizontal table which is movable along a first horizontal axis and can support a piece of sheet metal being processed, characterized in that it comprises the steps of:

providing a horizontal discharge table and a horizontal loading table in positions in which these tables are side by side and substantially aligned with the horizontal plane of the table of the machine tool, providing an unprocessed piece of sheet metal to be supplied to the machine tool on the loading table, positioning the table of the machine tool in a discharge position in which it is substantially beside the discharge table, transferring the processed piece of sheet metal from the table of the machine tool to the discharge table causing it to slide on the bearing surfaces of these tables along a second horizontal axis perpendicular to the first axis, moving the table of the machine tool along the first axis to a loading position in which it is substantially beside the loading table, and transferring the unprocessed piece of sheet metal from the loading table to the table of the machine tool by causing it to slide on the bearing surfaces of the tables, along the second horizontal axis.

2. A method according to claim 1, characterized in that the unprocessed pieces of sheet metal are disposed on the loading table by a preparation sequence comprising the steps of:

positioning the discharge table above a stack of unprocessed pieces of sheet metal, taking a piece of sheet metal from the top of the stack with the use of gripping means situated on the lower surface of the discharge table, and positioning the discharge table above the loading table and depositing the piece of sheet metal on the upper surface of the loading table.

3. A method according to claim 1, characterized in that the processed pieces of sheet metal are discharged from the discharge table in a discharge sequence comprising the steps of:

bringing the discharge table above an area for the deposition of processed pieces, restraining the processed piece of sheet metal situated on the discharge table by means of a stationary catch element which prevents the piece of sheet metal from moving along the direction of movement of the discharge table, and moving the discharge table in the direction of movement so as to discharge the piece of sheet metal into the deposition area.

4. A method according to claim 1, characterized in that the loading table and the discharge table are carried by a lifting platform which is movable vertically and can take up a raised position in which the plane of the discharge table is above the area for the deposition of the processed pieces and a lowered position in which the plane of the discharge table is above a stack of unprocessed pieces of sheet metal.

5. A device for the automatic loading and discharge of pieces of sheet metal onto and from a machine tool having a horizontal table which is movable along a first horizontal axis and can support a piece of sheet metal being processed, characterized in that it comprises:

a stationary base, a lifting platform movable vertically relative to the base, a horizontal discharge table movable relative to the lifting platform parallel to the first axis, a horizontal loading table movable in a vertical direction relative to the lifting platform between a position in which it is below the plane of the discharge table and a position in which it is substantially aligned with the discharge table, a stationary guide beam extending along a second horizontal axis perpendicular to the first axis, and an entrainment carriage which has means for gripping pieces of sheet metal and is movable along the guide beam between a position for picking up pieces on the loading table or releasing pieces onto the discharge table and a position for picking up pieces from and releasing pieces onto the table of the machine tool.

6. A device according to claim 5, characterized in that the base has a storage region in which an area for the deposition of the processed pieces of sheet metal and a stack of unprocessed pieces of sheet metal are disposed one above the other.

7. A device according to claim 6, characterized in that the discharge table has gripping means on its lower surface for gripping an unprocessed piece of sheet metal.

8. A device according to claim 5, characterized in that it comprises a restraining device which can prevent the movement of a processed piece of sheet metal bearing on the discharge table in the direction of movement of the discharge table so that the movement of the discharge table parallel to the first axis causes the processed piece of sheet metal to be discharged into the deposition area.

* * * * *

UNITED STATES PATENT AND TRADEMARK OFFICE

CERTIFICATE OF CORRECTION

PATENT NO. : 5,765,984

DATED : June 16, 1998

INVENTOR(S) : Stefano Vergano et al.

It is certified that error appears in the above-indentified patent and that said Letters Patent is hereby corrected as shown below:

On the cover page, above the line and under "United States Patent" change "Stefano et al" to --Vergano et al.--.

In section *[75] Inventors*, change "Vergano Stefano; Scavino Mario; Azzinnaro Franco" to --Stefano Vergano; Mario Scavino; Franco Azzinnaro;--

Signed and Sealed this

Sixteenth Day of March, 1999

*Attest:*

*Attesting Officer*

Q. TODD DICKINSON

*Acting Commissioner of Patents and Trademarks*